US006499653B2

(12) United States Patent
Baden

(10) Patent No.: US 6,499,653 B2
(45) Date of Patent: Dec. 31, 2002

(54) GLUELESS FOLDING ENVELOPE

(76) Inventor: Sharon Kay Baden, 2130 Superior Ave., Cleveland, OH (US) 44114

( * ) Notice: Subject to any disclaimer, the term of this patent is extended or adjusted under 35 U.S.C. 154(b) by 0 days.

(21) Appl. No.: 09/789,031

(22) Filed: Feb. 20, 2001

(65) Prior Publication Data

US 2001/0042782 A1 Nov. 22, 2001

Related U.S. Application Data

(63) Continuation of application No. 29/098,299, filed on Dec. 23, 1998, now Pat. No. Des. 440,251.

(51) Int. Cl.[7] ..... B65D 27/22
(52) U.S. Cl. ..... 229/84; D19/3
(58) Field of Search ..... D19/3; 229/84, 229/82

(56) References Cited

U.S. PATENT DOCUMENTS

| | | | | | |
|---|---|---|---|---|---|
| 149,484 | A | * | 4/1874 | Kelly et al. | 229/842 |
| 646,638 | A | | 4/1900 | Cutler | |
| 761,004 | A | | 5/1904 | Meadows | |
| 766,075 | A | * | 7/1904 | Swank | 229/842 |
| 902,341 | A | * | 10/1908 | Staley | 229/842 |
| 917,383 | A | | 4/1909 | Von Eschen et al. | |
| 1,187,317 | A | | 6/1916 | Holmes | |
| 1,285,238 | A | | 11/1918 | Kramer | |
| 1,411,547 | A | | 4/1922 | Winter | |
| 1,446,669 | A | | 2/1923 | Sherlock | |
| 1,506,058 | A | * | 8/1924 | Griffin | 229/842 |
| 1,875,804 | A | | 9/1932 | Dicicco | |
| 2,060,149 | A | | 11/1936 | Walton, Jr. | |
| 2,354,726 | A | * | 8/1944 | Williamson | 229/842 |
| D287,735 | S | | 1/1987 | Leyland | |
| D440,251 | S | * | 4/2001 | Baden | D19/3 |

FOREIGN PATENT DOCUMENTS

| | | | | |
|---|---|---|---|---|
| FR | 319997 | * | 11/1902 | 229/84 |
| FR | 631361 | * | 12/1927 | 229/842 |

* cited by examiner

*Primary Examiner*—Jes F. Pascua
(74) *Attorney, Agent, or Firm*—Fay, Sharpe, Fagan, Minnich & McKee, LLP

(57) ABSTRACT

In accordance with the present invention, an envelope is provided. The envelope comprises a front wall, a bottom wall connected to the front wall along a lower fold line, and a rear wall connected to the bottom wall along a fold line. The wall section has a slot located along a vertical centerline thereof and a flap located along a distal edge thereof. The flap has a notch. A closure flap is connected to the front wall along an upper fold line. The flap has a V-shaped notch along a distal edge thereof that defines a pair of tongues in the flap. A pair of opposing wing sections are each connected to the front wall along side fold lines. The wing sections each have a base portion that partially defines a side wall and a wing portion for threading engagement with the slot of the closure flap. The wing portions have wing tips for tucking engagement with sides of the rear wall.

20 Claims, 3 Drawing Sheets

GLUELESS FOLDING ENVELOPE

CROSS-REFERENCE TO RELATED APPLICATION

This application is a continuation of U.S. Design Application Ser. No. 29/098,299, filed Dec. 23, 1998 now Des. 440,251.

BACKGROUND OF THE INVENTION

The present invention relates to envelopes and, more particularly, to a new and improved glueless folding envelope and a method of forming such an envelope. The present invention finds particular application as a paper envelope and is described herein with particular reference thereto. However, it is to be appreciated that the present invention is also amenable to other applications.

BRIEF SUMMARY OF THE INVENTION

In accordance with the present invention, an envelope is provided. The envelope comprises a front wall, a bottom wall connected to the front wall along a lower fold line, and a rear wall connected to the bottom wall along a fold line. The wall section has a slot located along a vertical centerline thereof and a flap located along a distal edge thereof. The flap has a notch. A closure flap is connected to the front wall along an upper fold line. The flap has a V-shaped notch along a distal edge thereof that defines a pair of tongues in the flap. A pair of opposing wing sections are each connected to the front wall along side fold lines. The wing sections each have a base portion that partially defines a side wall and a wing portion for threading engagement with the slot of the closure flap. The wing portions have wing tips for tucking engagement with sides of the rear wall.

A main advantage of the present invention resides in the provision of an envelope and a method of forming the envelope that does not require glue to maintain the shape of the envelope.

Another primary advantage of the present invention is the provision of fold lines and a method of using the fold lines to define an expandable envelope pocket.

A further advantage of the present invention is the provision of an envelope that requires only folding to form the envelope.

Still other advantages and benefits of the invention will be apparent to those skilled in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE INVENTION

Figure 1:
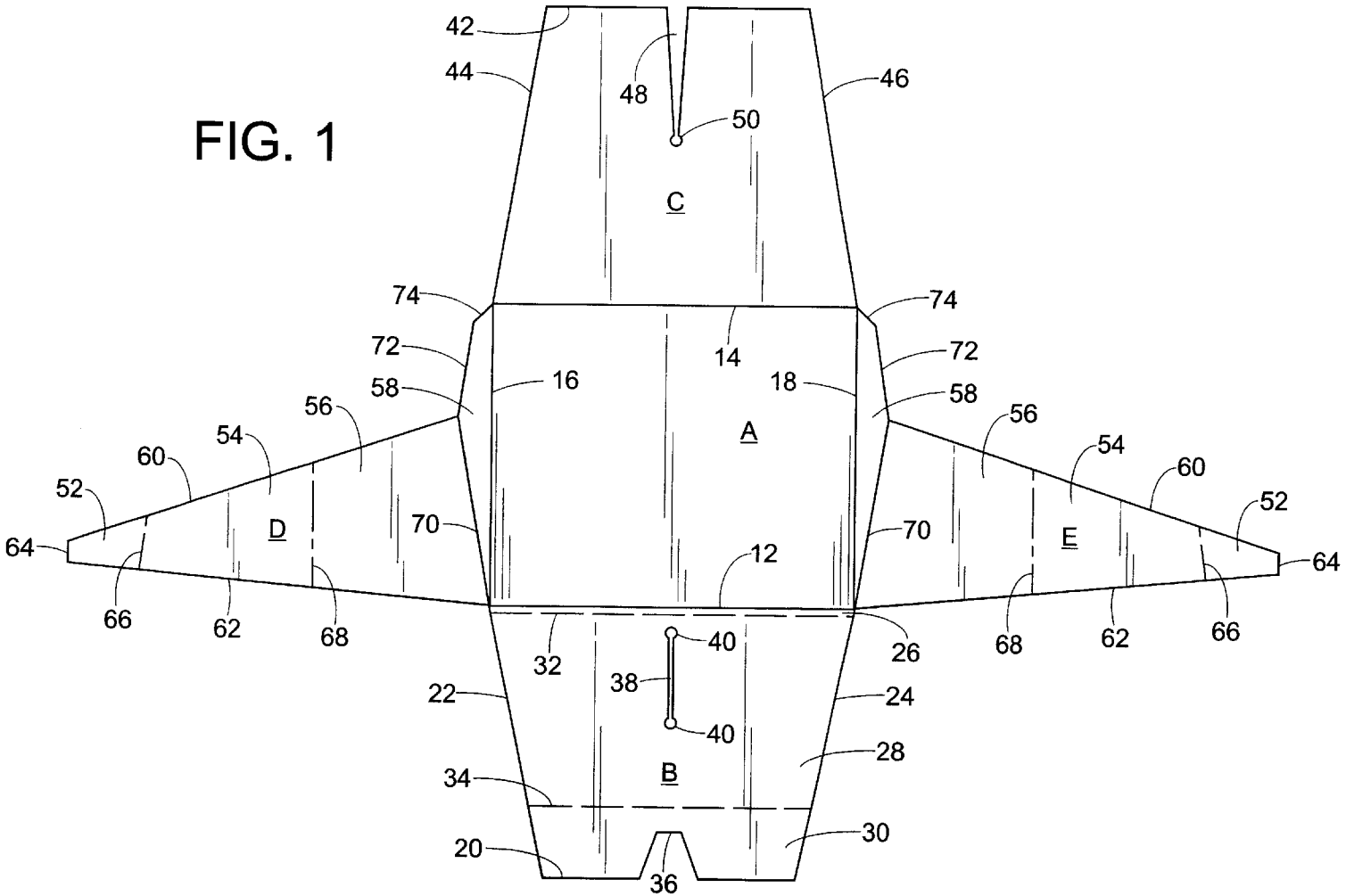
FIG. 1 is a plan view of an envelope blank in accordance with the present invention.

With reference to FIG. 1, an envelope blank comprises a central section A, a lower section B, an upper section C, a first wing section D, and a second wing section E. The central section A, also referred to herein as a front wall and a front section, is a generally rectangular shape defined by a plurality of section score marks or fold lines. More particularly, a lower fold line or first section score mark 12 delineates a boundary between the central section A and the lower section B, also referred to herein as a lower rear section, a rear section, and a rear wall. An upper fold line or second section score mark 14 delineates a boundary between the central section A and the upper section C. A side fold line or third section score mark 16 and a side fold line or fourth section score mark 18 delineate boundaries between the central section A and, respectively, the first wing section D and the second wing section E.

The lower section B connected to the central section along a bottom edge is defined by the first section score mark 12, a lower edge 20, and a pair of opposing first and second sides 22,24. The opposing sides 22,24 taper inwardly toward one another from the first section score mark 12 to the lower edge 20. The lower section B includes an upper portion 26, also referred to herein as a bottom wall and a pocket portion, a middle portion 28, also referred to herein as a rear wall and a slot portion, and a lower portion or tucking flap 30. The middle portion 28 and the lower portion 30 may be together referred to as a body portion. The upper portion 26 is defined between the first section score mark 12 and an upper score mark 32. The middle portion or base 28 is defined between the upper score mark 32 and a lower score mark 34. The lower portion 30 is defined between the lower score mark 34 and the lower edge 20.

The lower portion 30 further includes a notch 36 located at or near a center of the lower edge 20. The middle portion 28 includes a slot 38 extending along a vertical toward the upper score mark 32. A pair of radical cutouts 40 are disposed at opposing end of the slot 38.

The upper section C, also referred to herein as a closure flap and a closure flap section, connects to the central section A along a top edge and is defined by the second section score mark 14, an upper edge 42, and a pair of opposing sides 44,46. The opposing sides 44,46 taper inwardly toward one another from the second section score mark 14 to the upper edge 42. The upper section C includes a generally V-shaped notch 48 located at or near a center of the upper edge 42 defining a pair of tongues. A radial cutout 50 is disposed at the tip or pointed area of the V-shaped notch 48.

The first wing section D and the second wing section E are mirrored copies of one another and, accordingly, share like reference numerals to identify like elements. The wing sections D,E include outer wing portions 52, middle wing portions 54, inner wing portions 56, and base portions 58.

The wing tips or outer wing portions 52 are defined by an upper wing edge 60, a lower wing edge 62, a wing tip edge 64, and a first wing score mark 66, also referred to herein as a first wing fold line. The second or middle wing portions 54 are defined by the upper wing edge 60, the lower wing edge 62, the first wing score mark, and a second wing score mark 68, also referred to herein as a second wing fold line. The first or inner wing portions 56 are defined by the upper wing edge 60, the lower wing edge 62, the second wing score mark 68, and a third wing score mark 70.

The base portions 58 generally connect the wing portions 52,54,56 to the central section A along side edges of the central section A. The base portions 58 are defined by the respective third and fourth section score lines 16,18, the third wing score marks 70, and angled sides 72,74. The third wing score marks 70, also referred to herein as front section side fold lines, are positioned at an angle that is substantially similar to the taper of the opposing sides 22,24 of the lower section B.

To manufacture the envelope blank described above, a blank sheet of paper or card stock is cut by a press or other means to create the envelope blank illustrated in FIG. 1. Of course, multiple envelopes blanks can be cut from a single blank sheet. Further, the envelope blank can be constructed of any desire material and in any size desired for a particular purpose or use.

To form a completed envelope from the envelope blank shown in FIG. 1, the lower section B is folded inwardly along the first section score mark or front section lower fold line 12 toward the central section A until the lower section B is resting flatly upon the central section A to create a fold line along the first section score mark 12. The lower section B is then returned to its initial position. The middle and lower portions 28,30 are then together folded inwardly along the upper score mark 32 toward the central section A until the portions 28,30 are together resting flatly upon the upper portion 26 and the central section A to create a fold line along the upper score mark 32. The portions 28,30 are then returned to their initial positions. The lower portion 30 is then folded inwardly along the lower score mark 34 toward the middle portion 28 until the lower portion 30 is resting flatly upon the middle portion 28. The lower portion 30 remains in this position.

Next, the first wing section D is folded inwardly along the third section score mark 16 toward the central resting flatly upon the central section A. The wing portions 52,54,56 are then folded outwardly along the third wing score mark 70 such that the inner wing portion 56 is generally resting flatly upon the base portion 58 of the first wing section D to create a fold line along the third wing score mark 70. The wing portions 52,54,56 are then folded back inwardly toward the central section A to the prior folded positions. The outer and middle wing portions 52,54 are then folded outwardly along the second wing score mark 68 such that the middle wing portion 54 is generally resting flatly upon the inner wing portion 56.

The same steps are then repeated on the second wing section E. More particularly, the second wing section E is folded inwardly along the fourth section score mark 18. The wing portions 52,54,56 are then folded outwardly along the third wing score mark 70 to create a fold line. The wing portions 52,54,56 are then folded back inward to their prior positions. Finally, the outer and middle wing portions 52,54 of the second wing section E are folded outward along the second wing score mark 68.

Next, the respective outer and middle wing portions 52,54 are simultaneously folded inward until the respective portions 52,54 are in abutting contact with one another and perpendicular relative to the central section A. The respective outer wing portions 52 are then folded over outwardly until the respective outer wing portions 52 are resting against the respective middle wing portions 54.

Figure 5:
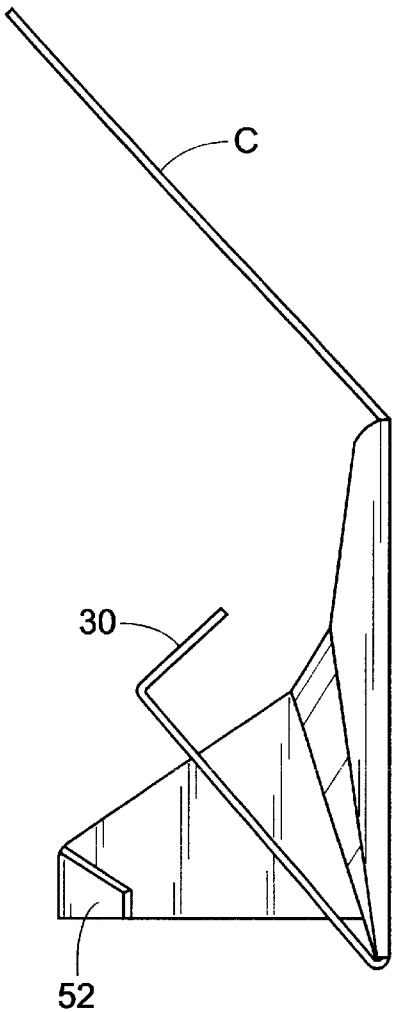
FIG. 5 is a side view of the partially completed envelope of FIG. 4.
Figure 4:
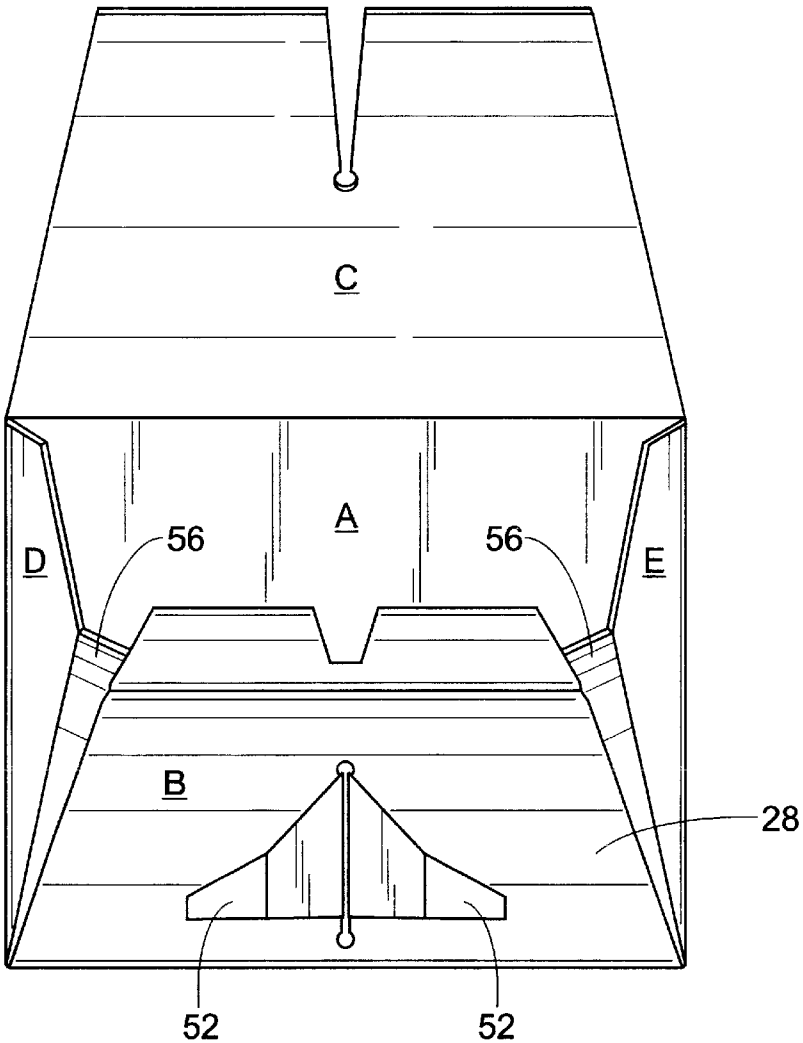
FIG. 4 is a rear view of a partially completed envelope in accordance with the present invention.

Continuing, the lower section B, with the lower portion 30 still folded over upon the middle portion 28, is again folded inwardly along the first section score mark 12 where a fold line was previously created until the lower section B is perpendicular to the central section A. The wing portions 52,54 of the wing sections D,E are then threaded through the slot 38 while, at the same time, the lower section B is folded further inwardly along the upper score mark 32 toward the central section A. With reference to FIGS. 4 and 5, the outer wing portions 52 and the lower portion 30 of the lower section B can be released from abutting contact with their respective sections once the wing sections D,E are threaded through the lower section B.

Next, the lower portion 30 of the lower section B is tucked between the central section A and the wing inner portions 56. In a similar fashion, the outer wing portions 52 are tucked between the inner wing portions 56 and the middle portion 28 of the lower section B. An envelope pocket is created between the central section A, the base portions 52 of the wing sections D,E, and the upper and middle portions 26,28 of the lower section B.

Figure 2:
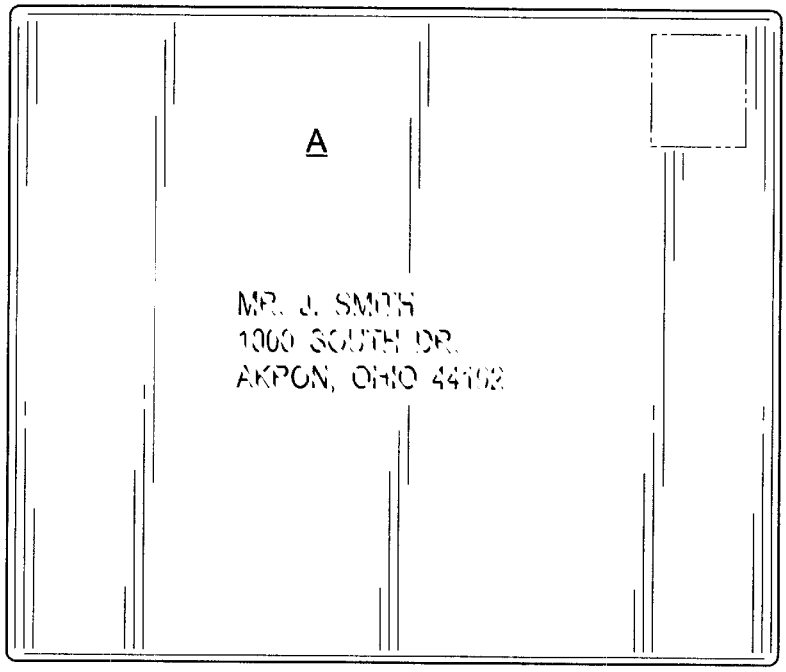
FIG. 2 is a front view of a completed envelope in accordance with the present invention.
Figure 3:
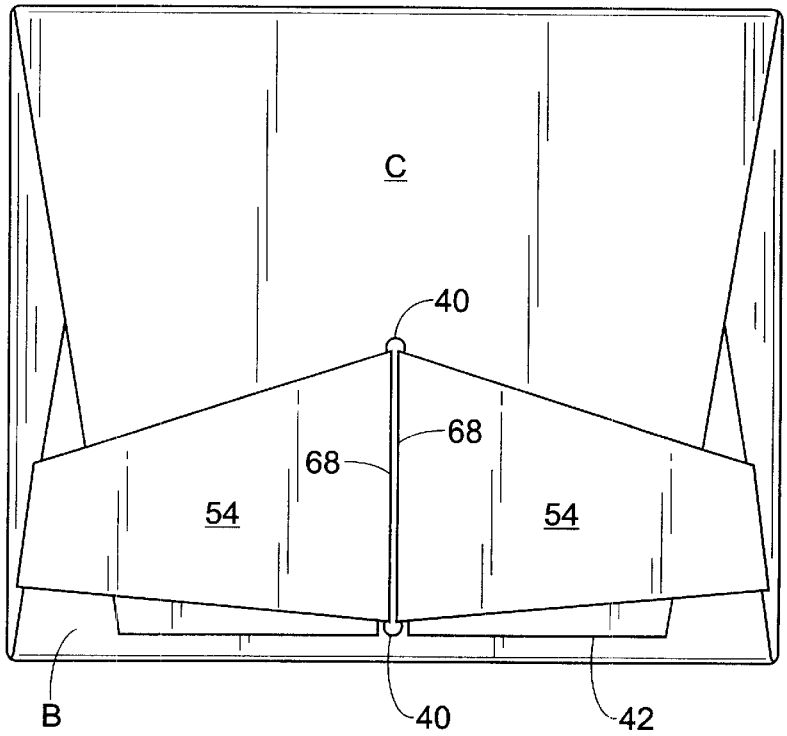
FIG. 3 is a rear view of the completed envelope of FIG. 2.

With additional reference to FIG. 3, the envelope pocket can be closed by folding the top section C inwardly toward the central section A along the second section score mark 14 and tucking the upper section C between the bottom section B and the middle portions 54 of the wing sections D,E. The V-shaped slot 48 allows this closure by permitting the folded wing sections D,E to fit within the V-shaped slot 48 along the second wing score marks 68. With reference to FIG. 2, the other side of the envelope is suitable for addressing as is conventional in the art.

The invention has been described with reference to the preferred embodiments. Obviously, modifications and alterations will occur to others upon reading and understanding the preceding detailed description. For example, the lower section B may be formed without an upper portion 26. Likewise, the lower section B may be formed without a lower portion or flap 30. The notch 36 can be configured of different dimensions or may not exist at all. Another alteration may be that the V-shaped notch 48 could be of a different shape or not exist. Of course, other variations are also possible. It is intended that the invention be construed as including all such modifications and alterations insofar as they are within the scope of the appended claims or the equivalents thereof.

Having thus described the preferred embodiments, the invention is now claimed to be:

1. An envelope comprising:

a front wall;

a bottom wall connected to the front wall along a lower fold line;

a rear wall connected to the bottom wall along a fold line, the rear wall having a slot located along a vertical centerline thereof and a flap located along a distal edge thereof;

a closure flap connected to the front wall along an upper fold line, the flap having a notch along a distal edge thereof that defines a pair of tongues in the flap; and a pair of opposing wing sections each connected to the front wall along side fold lines, the wing sections each have a base portion that partially defines a side wall and a wing portion for threading engagement with the slot of the closure flap, the wing portions have wing tips for tucking engagement with sides of the rear wall.

2. A folding envelope comprising:

a generally rectangular front section;

a rear section connected to the front section along a front section lower fold line, the rear section having a slot therein and first and second sides;

a closure flap section connected to the front section along a front section upper fold line;

a first wing section connected to the front section along a front section side fold line, the first wing section having a first wing fold line located thereon for allowing a portion of the first wing section to thread through the slot and a second wing fold line for allowing another portion of the first wing section to attach to the first side of the rear section; and a second wing section connected to the front section along another front section side fold line, the second wing section having a first wing fold line located thereon for allowing a portion of the second wing section to thread through the slot and a second wing fold line for allowing another portion of the second wing section to attach to the second side of the rear section.

3. The folding envelope of claim 2 wherein the rear section includes a pocket portion adjacent the front section for defining a bottom of an envelope pocket and a body portion adjacent a distal end of the lower rear section for defining a rear of the envelope pocket, the portion having the slot therethrough.

4. The folding envelope of claim 3 wherein the body portion includes a base adjacent the pocket portion and a tucking flap connected to the base along a fold line.

5. The folding envelope of claim 4 wherein the flap includes a notch in a distal edge thereof.

6. The folding envelope of claim 2 wherein the rear section includes slot portion and a tucking flap portion adapted to engage the wing sections to secure a pocket of the envelope.

7. The folding envelope of claim 6 wherein the slot portion includes a flap connected to the slot portion along a lower rear section fold line adapted to engage the wing sections to secure a pocket of the envelope.

8. The folding envelope of claim 6 wherein the tucking flap portion includes a notch in a distal edge thereof.

9. The folding envelope of claim 2 wherein the closure flap section includes a notch located on a distal edge of the closure flap section, the notch defining a pair of tongues for tucking engagement with the rear section and the first and second wing sections threaded through the slot.

10. The folding envelope of claim 2 wherein the first and second wing sections each include a base portion for defining sides of an envelope pocket.

11. An envelope comprising:

a front section;

a rear section connected to a bottom edge of the front section and folded such that the rear section is positioned adjacent the front section;

a slot disposed in the rear section; and a wing section connected to a side edge of the front section, the wing section folded such that a first portion is positioned between the front section and the rear section and a second portion distally located relative to the first portion is threaded through the slot and folded against the rear section, wherein the wing tip is folded around a side of the rear section.

12. The envelope of claim 11, wherein the wing section second portion includes a wing tip for maintaining the second portion in abutting relation with the rear section.

13. The envelope of claim 11, further comprising:

a second wing section connected to an opposite side edge of the front section, the second wing section folded such t hat a second wing first portion is positioned between the front section and the rear section and a second wing second portion distally located relative to the second wing first portion is threaded through the slot and folded against the rear section.

14. The envelope of claim 11, further comprising:

a closure flap connected to a top edge of the front section.

15. The envelope of claim 11, further comprising:

envelope pocket sides, the first envelope pocket side positioned between the front section and the rear section and the second envelope pocket side positioned between the wing section and the front section.

16. An envelope comprising:

a front section;

a rear section connected to a bottom edge of the front section and folded such that the rear section is positioned adjacent the front section;

a slot disposed in the rear section; and a wing section connected to a side edge of the front section, the wing section folded such that a first portion is positioned between the front section and the rear section and a second portion distally located relative to the first portion is threaded through the slot and folded against the rear section, wherein the rear section includes a flap located at a distal end thereof for tucking engagement with one of (a) the rear section and the wing section first portion and (b) the rear section and the front section.

17. A method of folding an envelope blank into an envelope, the method comprising:

folding a first wing section inwardly toward a central section until the first wing section is generally resting flatly upon the central section;

folding a first portion of the first wing section back outwardly adjacent a vertical centerline of the central section until the first portion is resting flatly upon a second portion of the first wing section;

folding a second wing section inwardly toward a central section until the second wing section is generally resting flatly upon the central section and the first wing section;

folding a first portion of the second wing section back outwardly adjacent a vertical centerline of the central section until the first portion is perpendicular to the central section;

folding the first portion of the first wing section back inwardly until the first portion is perpendicular to the central section and abutting the first portion of the second wing section;

threading the first portions of the first and second wing sections through a slot in a lower section of the envelope blank while folding the lower section inwardly toward the central section until the lower section is generally resting flatly upon the central section and the second portions of the first and second wing sections;

further folding the first portions of the first and second wing sections outward until the respective first portions are resting upon the folded lower section;

folding respective wing tips of the first portions around and under the lower section to secure sides of an envelope pocket; and folding an upper section of the envelope blank inwardly toward the central section and tucking the upper section between one of (a) the first portions of the first and second wing sections and the lower section, (b) the lower section and the second portions of the first and second wing sections, and (c) the second portions of the first and second wing sections and the central section to close the envelope pocket.

18. The method of claim 17 wherein the step of folding the upper section includes the step of:

tucking a pair of flaps of the upper section between one of the first portions of the first and second wing sections and the lower section, and the lower section and the second portions of the first and second wing sections.

19. The method of claim 17 wherein the step of folding the lower section inwardly toward the central section includes one of the step of tucking a flap of the lower section under the second portions of the first and second wing sections and the step of tucking a flap of the lower section between the second portions of the first and second wing sections and the lower section.

20. The method of claim 17 wherein the step of prefolding all sections and portions to create fold lines precedes the steps of forming the envelope.

* * * * *